US007609219B2

(12) United States Patent
Hashimoto

(10) Patent No.: US 7,609,219 B2
(45) Date of Patent: Oct. 27, 2009

(54) SLOT ANTENNA

(75) Inventor: Yuhei Hashimoto, Tokyo (JP)

(73) Assignee: Sony Corporation, Tokyo (JP)

( * ) Notice: Subject to any disclaimer, the term of this patent is extended or adjusted under 35 U.S.C. 154(b) by 442 days.

(21) Appl. No.: 11/504,088

(22) Filed: Aug. 15, 2006

(65) Prior Publication Data

US 2007/0046555 A1 Mar. 1, 2007

(30) Foreign Application Priority Data

Aug. 23, 2005 (JP) ..... P2005-241348

(51) Int. Cl.
*H01Q 13/10* (2006.01)

(52) U.S. Cl. ..... 343/767

(58) Field of Classification Search ..... 343/767, 343/770

See application file for complete search history.

(56) References Cited

U.S. PATENT DOCUMENTS

| | | | | |
|---|---|---|---|---|
| 6,351,246 | B1 | 2/2002 | McCorkle | |
| 6,518,930 | B2 * | 2/2003 | Itoh et al. | 343/767 |
| 6,975,276 | B2 * | 12/2005 | Brown | 343/767 |

FOREIGN PATENT DOCUMENTS

| | | |
|---|---|---|
| JP | 63-181505 | 7/1988 |
| JP | 01-295503 | 11/1989 |
| JP | 06-334431 | 12/1994 |
| JP | 07-83217 | 9/1995 |
| JP | 2001-053521 | 2/2001 |
| JP | 2002-084128 | 3/2002 |
| JP | 2003-304115 | 10/2003 |
| JP | 2003-533080 | 11/2003 |

OTHER PUBLICATIONS

"Bluetooth", IMac Fan, http://pcweb.my.com.jp/news/2002/09/03/10.html, 2 pages, (2003).

"Advent of Revolutionary Technology-Ultra Wideband", Nikkei Electronics, pp. 55-66, Mar. 11, 2002.

* cited by examiner

*Primary Examiner*—Michael C Wimer
(74) *Attorney, Agent, or Firm*—Finnegan, Henderson, Farabow, Garrett & Dunner, L.L.P.

(57) ABSTRACT

A slot antenna including: a dielectric substrate; a conductor pattern formed on a first surface of the dielectric substrate; a ground layer formed on a second surface of the dielectric substrate; a feeding point disposed at substantially a center of one side of the conductor pattern; a microstrip line extending from the feeding point to substantially a center of the conductor pattern; and a slot made with a predetermined width at a position at which the slot straddles a center line of the dielectric substrate, the center line passing through the feeding point, in the ground layer.

6 Claims, 11 Drawing Sheets

SLOT ANTENNA

CROSS REFERENCES TO RELATED APPLICATIONS

The present invention contains subject matter related to Japanese Patent Application JP 2005-241348 filed in the Japanese Patent Office on Aug. 23, 2005, the entire contents of which being incorporated herein by reference.

BACKGROUND OF THE INVENTION

1. Field of the Invention

The present invention relates to a small and thin slot antenna that can be incorporated into a consumer device, and particularly to a slot antenna that is incorporated into a consumer device and has excellent characteristics in a UWB service band.

2. Description of the Related Art

More specifically, the present invention relates to a slot antenna that is incorporated into a consumer device, has stable characteristics without being affected by an electromagnetic wave from a peripheral circuit within the device or a reflector around the device, and eliminates effects on a peripheral high-frequency circuit, and particularly to a slot antenna that can be used at a very short distance to another identical slot antenna when performing transmission and reception to and from the other identical slot antenna, and can be used in a wide communication area.

Attention has recently been directed to a radio communication system using a very wide frequency band of 3.1 GHz to 10.6 GHz, which system is referred to as "Ultra WideBand (UWB) communications". While the UWB communications assume a PAN (Personal Area Network) with a communication distance of about 10 m, the UWB communications are expected to be put to practical use as a radio communication system for achieving a short-distance ultrahigh-speed transmission at a transmission speed of about 100 Mbps (see Mar. 11, 2002, issue of Nikkei Electronics "Advent of Revolutionary Technology-Ultra Wideband" pp.55 to 66, for example).

In IEEE802.15.3, for example, a data transmission system for transmitting data having a packet structure including a preamble is devised as an access control system for the UWB communications. Intel Corporation of the U.S. is considering a wireless version of USB (Universal Serial Bus) spread as a general-purpose interface for personal computers as a UWB application.

While UWB is a radio communication system for short distances because of its transmission power, UWB enables high-speed radio transmission. Therefore UWB can be applied as a system for consumer use when a mobile digital device such as a digital camera, a music reproducing device or the like is connected to a television set or a personal computer at a short distance by radio, so that contents such as music, images and the like can be transmitted as data at a high speed.

Meanwhile, in consideration of the capability of data transmission exceeding 100 Mbps and ease of creation of an RF circuit, transmission systems using a UWB low band of 3.1 to 4.9 GHz without occupying the transmission band of 3.1 GHz to 10.6 GHz are being actively developed.

Recently, there appeared a mobile device incorporating a radio communication function for a purpose of exchanging data such as images, music and the like with a personal computer (see http://pcweb.mycom.co.jp/news/2002/09/03/10.html, for example). The present inventor et al. consider that a data transmission system using the UWB low band is one of effective radio communication technologies to be incorporated into this kind of small mobile device.

The present inventor et al. consider that when UWB communication technology is applied to a mobile device, an antenna for UWB transmission needs to be designed to be of a small size, as with the main body of the device. In addition, to incorporate the antenna into the device, the antenna needs to be designed such that the radio system obtains tolerable frequency characteristics by avoiding effects of an electromagnetic wave from another circuit within the device and effects of a reflector around the device. Conversely, effects of a high-frequency component of a wide band used by the UWB antenna on another high-frequency circuit within the same device need to be eliminated.

Since UWB is a short-distance high-capacity radio communication system, UWB is expected to be applied to high-speed data transmission in an ultrashort-distance area such as in an ultrahigh-speed DAN (Device Area Network) for short distances including a storage device. In such a case, the UWB antenna needs to secure both excellent reflection characteristics and excellent coupling characteristics as antenna characteristics even at an ultrashort distance of about 5 to 150 mm.

An antenna basically uses a resonance phenomenon, and a resonance frequency is determined by the length of the antenna. Hence, in UWB communication in which transmission is performed using a wide frequency band, it is difficult to produce resonance over the service frequency band (3.1 GHz to 10.6 GHz).

When UWB is applied to ultrashort-distance communication, it is difficult to obtain desired antenna characteristics because an electric field and a magnetic field behave independently in a near electromagnetic field of the length of about one wave. While this may not be the case with a narrow band, reflection characteristics need to be obtained in a wide range in UWB communication, and therefore it is more difficult to obtain desired antenna characteristics.

Further, when antennas are used at an ultrashort distance, there is reflection from a device including the antennas performing communication and reflection from the ground board of the antennas. Therefore design for obtaining desired characteristics is difficult.

To ensure high-capacity communication at 100 Mbps or more such as UWB communication or the like needs an antenna to be designed such that reflection characteristics are −10 dB or lower within a bandwidth of a defined specification. In addition, to obtain a throughput of 100 Mbps or more within the bandwidth of the UWB defined specification needs the antenna to be designed such that the coupling characteristics of the antenna do not have a sharp gain attenuation, and an overall gain is at a certain level or higher.

When decreasing size and thickness is considered, a so-called patch antenna and a slot antenna can be cited. The patch antenna is formed by arranging a radiating conductor and a ground conductor in such a manner as to be opposed to each other with an insulating material as an interposed object. The slot antenna is formed by a conductor pattern, a ground layer, and a dielectric layer interposed between the conductor pattern and the ground layer, with a slot made in the ground layer.

For example, a low-profile patch antenna having a wide band and sufficient gain is proposed in which a substance having a conductivity characteristic such that conductivity of the substance is about 0.1 or more and 10 or less is interposed between a radiating conductor and a conductor ground board, whereby the substance having the conductivity characteristic causes a proper amount of signal leakage between the conductor ground board and the radiating conductor (see Japanese Patent Laid-Open No. 2003-304115, for example).

While the slot antenna and the patch antenna are both advantageous in terms of reduction of antenna size and thickness, the slot antenna and the patch antenna do not inherently provide desired characteristics over a wide band. Thus, whichever structure is employed for an antenna, to design the antenna as an antenna for UWB needs some device for widening the band.

In general, when the slot antenna and the patch antenna have equal dimensions, the slot antenna can obtain a wider band than the patch antenna. The patch antenna has an operating band of a few percent as an antenna. Hence, the present inventor et al. consider that the slot antenna is more appropriate as an antenna for UWB to be used within a consumer device.

When the slot antenna is used as an antenna for UWB within a consumer device, and when radio communication is performed at an ultrashort distance, there are problems of effects of an electromagnetic wave from another circuit within the device and effects of a reflector around the device, effects of a high-frequency component of a wide band being used on another high-frequency circuit within the same device, and reflection from the device including the antenna performing communication and reflection from the ground board of the antenna (described above). However, there are practically no publicly known techniques regarding antennas for UWB to be incorporated into devices.

SUMMARY OF THE INVENTION

It is desirable to provide an excellent small and thin slot antenna that is incorporated into a consumer device and can offer excellent characteristics in a UWB service band (specifically a UWB low band of 3.1 to 4.9 GHz).

It is also desirable to provide an excellent slot antenna of a UWB device incorporated type that can offer stable characteristics without being affected by an electromagnetic wave from a peripheral circuit within the device or a reflector around the device, and can eliminate effects on a peripheral high-frequency circuit.

It is also desirable to provide an excellent slot antenna of a UWB device incorporated type that can be used at a very short distance to another identical slot antenna when performing transmission and reception to and from the other identical slot antenna, and can be used in a wide communication area.

According to an embodiment of the present invention, there is provided a slot antenna including: a dielectric substrate; a conductor pattern formed on a first surface of the dielectric substrate; a ground layer formed on a second surface of the dielectric substrate; a feeding point disposed at substantially a center of one side of the conductor pattern; a microstrip line extending from the feeding point to substantially a center of the conductor pattern; and a slot made with a predetermined width at a position at which the slot straddles a center line of the dielectric substrate, the center line passing through the feeding point, in the ground layer. When the slot antenna is to be used within a small device, a metallic shield case to be mounted along the conductor pattern is further provided.

An embodiment of the present invention relates to a small and thin slot antenna that is mainly used within a consumer device and has excellent characteristics in a UWB specification band.

To ensure high-capacity communication at 100 Mbps or more such as UWB communication or the like, an antenna may need to be designed such that reflection characteristics are −10 dB or lower within the bandwidth of a defined specification. Further, to obtain a throughput of 100 Mbps or more within the bandwidth of the UWB defined specification, the antenna may need to be designed such that the coupling characteristics of the antenna do not have a sharp gain attenuation, and an overall gain is at a certain level or higher. A patch antenna and a slot antenna are known as small and thin antennas. However, both the patch antenna and the slot antenna are basically narrow-band antennas having an operating band of a few percent. When the slot antenna and the patch antenna have equal dimensions, the slot antenna can obtain a wider band. Hence, the present inventor et al. consider that the slot antenna is more appropriate as an antenna for UWB to be used within a consumer device.

The slot antenna is basically formed by a conductor pattern, a ground layer, and a dielectric layer interposed between the conductor pattern and the ground layer, with a slot made in substantially a center of the ground layer. A feeding point is disposed at substantially a center of one side of the conductor pattern, and a microstrip line extends from the feeding point to substantially a center of the conductor pattern. A fundamental operating principle is mainly that an electromagnetic field is radiated from the slot. An electric field formed so as to traverse the fed slot behaves to form a standing wave and resonate.

In an embodiment of the present invention, the disposition of the slot bored in the ground layer (that is, the left and right lengths of the slot from the feeding point and the width of the slot) is optimized. Further, when the slot antenna is incorporated into a device, a metallic shield case covering the conductor pattern side is attached to eliminate effects of an electromagnetic wave from a peripheral circuit within the device and effects of a reflector around the device. As a result, stable antenna characteristics are obtained, and the slot antenna can operate in a very wide frequency band of 3.1 to 4.9 GHz.

Further, an electric resistor is loaded over the slot in the ground layer such that both ends of the electric resistor are in contact with the ground layer. It is thereby possible to suppress reflection on the ground layer and bring out characteristics in a wide band.

In addition, loading a plurality of such electric resistors over one slot provides a degree of freedom to adjust impedance matching as compared with a case where one electric resistor is loaded. It is therefore possible to obtain excellent antenna characteristics over a wider band.

When the electric resistors are widely separated from the feeding part, a frequency range where impedance matching is achieved is narrowed. Therefore one or a plurality of electric resistors are loaded at appropriate positions near a center of the slot, whereby an effect of improving antenna characteristics can be obtained.

Appropriately loading a plurality of electric resistors having different resistance values at asymmetric positions with respect to the center of the slot (or the position of the feeding part) can contribute to ensuring of impedance matching with a higher degree of freedom and thus makes it possible to obtain excellent antenna characteristics over a wider band than loading two electric resistors at symmetric positions. However, when a plurality of electric resistor are to be loaded, a method of loading the electric resistors is limited because characteristics vary greatly according to the loading positions and the resistance values of the electric resistors.

An antenna for UWB according to an embodiment of the present invention ensures characteristics by using antennas of the same configuration as a coupler (one pair) for transmission and reception.

According to an embodiment of the present invention, it is possible to provide an excellent small and thin slot antenna that is incorporated into a consumer device and can offer excellent characteristics in a UWB service band (specifically a UWB low band of 3.1 to 4.9 GHz).

According to an embodiment of the present invention, it is also possible to provide an excellent slot antenna of a UWB device incorporated type that can offer stable characteristics without being affected by an electromagnetic wave from a peripheral circuit within the device or a reflector around the device, and can eliminate effects on a peripheral high-frequency circuit.

According to an embodiment of the present invention, it is also possible to provide an excellent slot antenna of a UWB device incorporated type that can be used at a very short distance to another identical slot antenna when performing transmission and reception to and from the other identical slot antenna, and can be used in a wide communication area.

In the slot antenna according to the above-described embodiment of the present invention, an electric field generated so as to traverse the slot at a time of feeding forms a standing wave and resonates, and the standing wave of the electric field shaped by an electric resistor loaded so as to straddle the slot is generated. Impedance matching can thus be achieved in a wide band. The slot antenna according to the above-described embodiment of the present invention can therefore be used as an antenna for UWB.

When the slot antenna according to the above-described embodiment of the present invention is incorporated into a consumer device, a metallic shield case is mounted over a conductor pattern layer on one side, whereby stable characteristics can be obtained without effects of surrounding electromagnetic waves. Therefore the slot antenna according to the above-described embodiment of the present invention can sufficiently function as a built-in antenna.

By applying the slot antenna according to the above-described embodiment of the present invention to each of a transmitter and a receiver and performing radio communication with the slots of the antennas facing each other, it is possible to stably obtain coupling characteristics that vary little and have levels providing high throughput in a UWB low band (3.1 to 4.9 GHz).

Other and further features and advantages of the present invention will become apparent from more detailed description on the basis of embodiments of the present invention to be described later and the accompanying drawings.

DETAILED DESCRIPTION OF THE PREFERRED EMBODIMENTS

Preferred embodiments of the present invention will hereinafter be explained in detail with reference to the drawings.

The present invention relates to a small and thin slot antenna that is mainly used within a consumer device and has excellent characteristics in a UWB specification band.

The slot antenna basically includes a conductor pattern, a ground layer, and a dielectric layer interposed between the conductor pattern and the ground layer, with a slot made at substantially a center of the ground layer. In addition, a feeding point is provided at substantially a center of one side of the conductor pattern, and a microstrip line extends from the feeding point to a center of the conductor pattern. A fundamental operating principle is mainly that an electromagnetic field is radiated from the slot. An electric field formed so as to traverse the fed slot forms a standing wave and resonates.

The slot antenna according to one embodiment of the present invention has main features of being used within a consumer device as a UWB antenna for a low band (3.1 to 4.9 GHz), in particular, and being applied to radio data transmission at an ultrashort distance. For this, a few devices are applied to the above-described fundamental structure.

Figure 1:
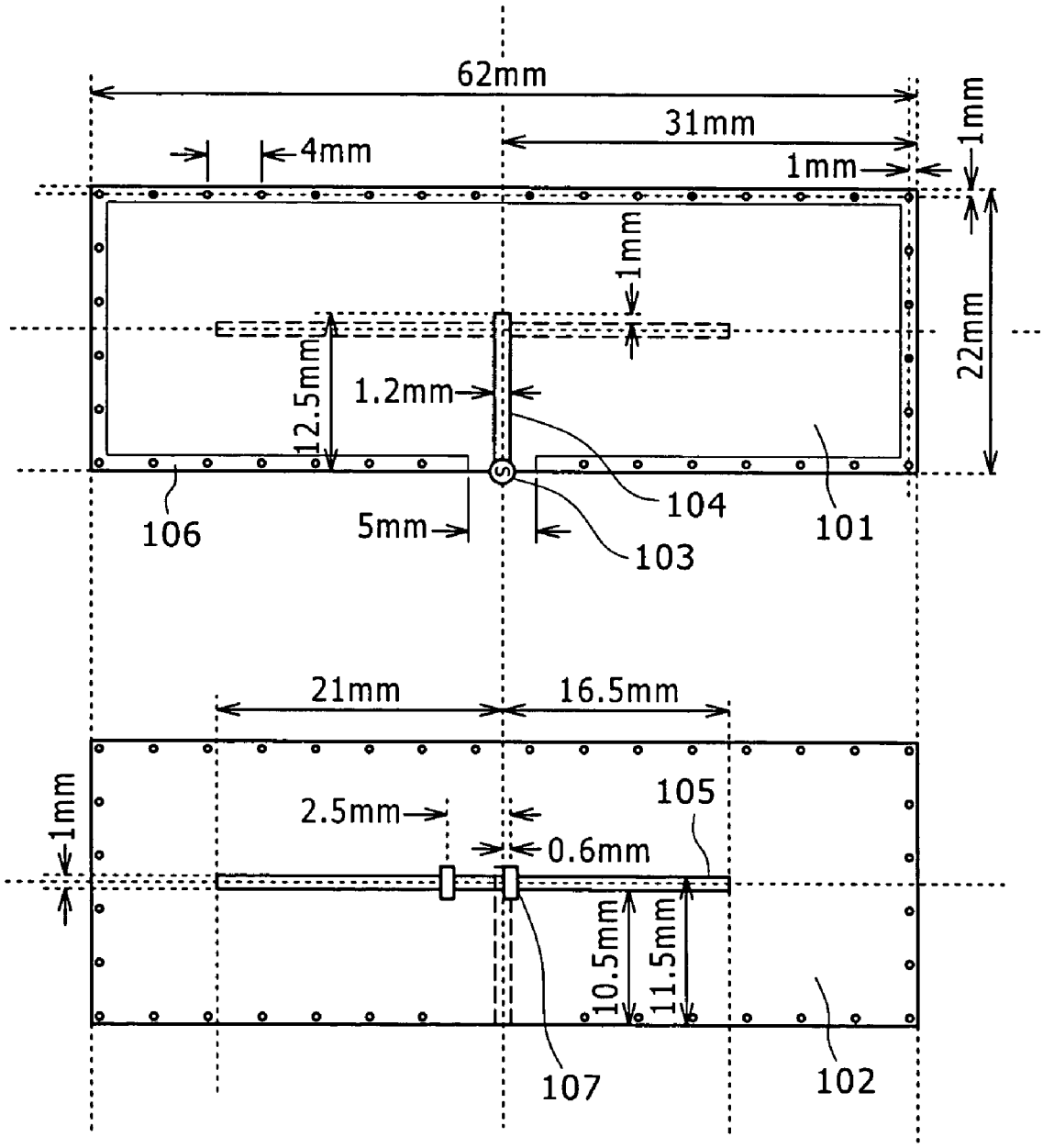
FIG. 1 is a diagram showing respective surface structures of a conductor pattern 101 side and a ground layer 102 side of a slot antenna according to one embodiment of the present invention.
Figure 2:
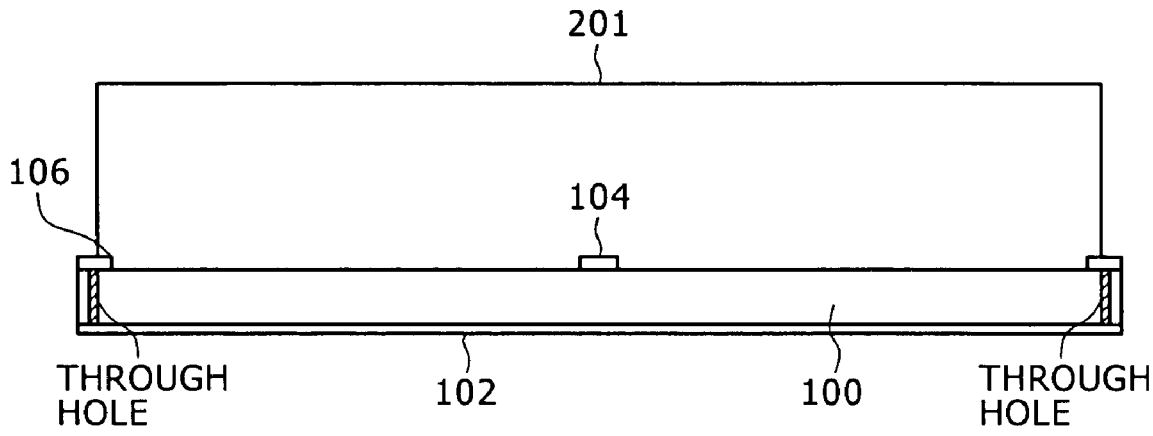
FIG. 2 is a diagram showing a sectional structure of the slot antenna shown in FIG. 1.

FIG. 1 shows respective surface structures of a conductor pattern 106 side and a ground layer 102 side of a slot antenna according to one embodiment of the present invention. FIG. 2 shows a sectional structure of the slot antenna (in a state of a metallic shield case being attached to the slot antenna).

As shown in FIG. 1 or 2, the slot antenna includes: a dielectric substrate 100; a conductor pattern 106 formed on one surface 101 of the dielectric substrate 100; and a ground layer 102 formed on another surface of the dielectric substrate 100.

The dielectric substrate 100 is formed of a material referred to as FR4, for example, and has a relative dielectric constant $\in$ of 4.2 to 4.8.

Figure 3:
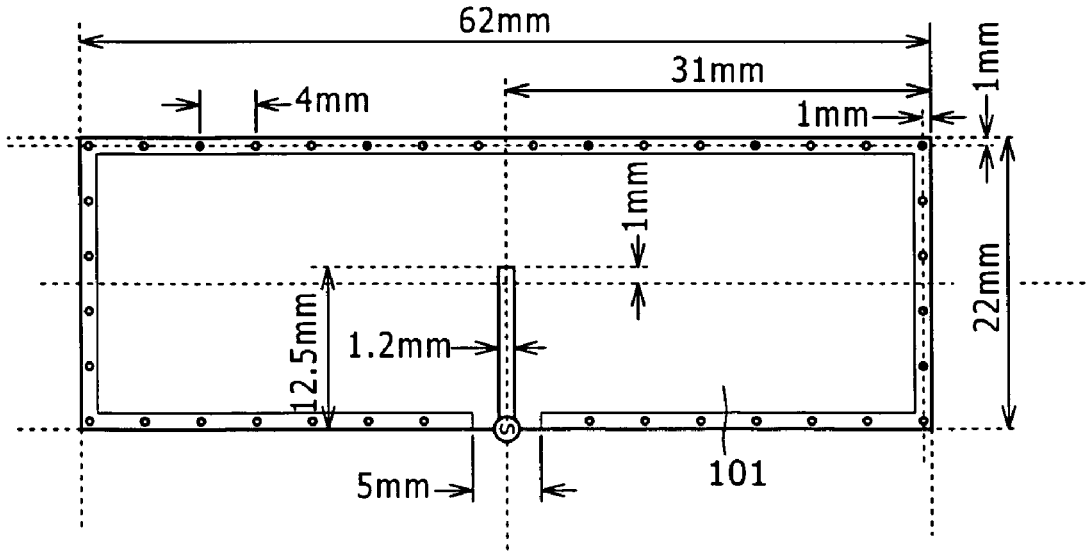
FIG. 3 is a diagram showing an example of configuration of the conductor pattern 106.

The conductor pattern 106 is a copper foil pattern formed along the periphery of one surface 101 of the dielectric substrate 100. FIG. 3 shows an example of configuration of the conductor pattern 106. A large number of through holes penetrating the dielectric substrate 100 are formed in the conductor pattern 106. The insides of these through holes are filled, and connected to the ground layer 102 formed on the underside of the dielectric substrate 100. The through holes are arranged at intervals of 4 mm.

A copper foil pattern extending from a peripheral part to substantially a central part of the dielectric substrate 100 (or the conductor pattern 106) is formed to constitute a microstrip line 104 on the surface 101 on the conductor pattern 106 side of the dielectric substrate 100. This microstrip line 104 is formed by a pattern in the form of a substantially straight line having a width of 1.2 mm, and is disposed on a center line that divides the dielectric substrate 100 having a rectangular shape into two equal parts, for example.

In order for the conductor pattern 106 and the microstrip line 104 to intersect each other, the microstrip line 104 is properly separated from both ends of the copper foil pattern by a 5 mm pattern separating part.

A peripheral end of the microstrip line 104 is situated at substantially the center of the pattern separating part for the conductor pattern 106, and forms a feeding point 103 for the conductor pattern 106.

Figure 4:
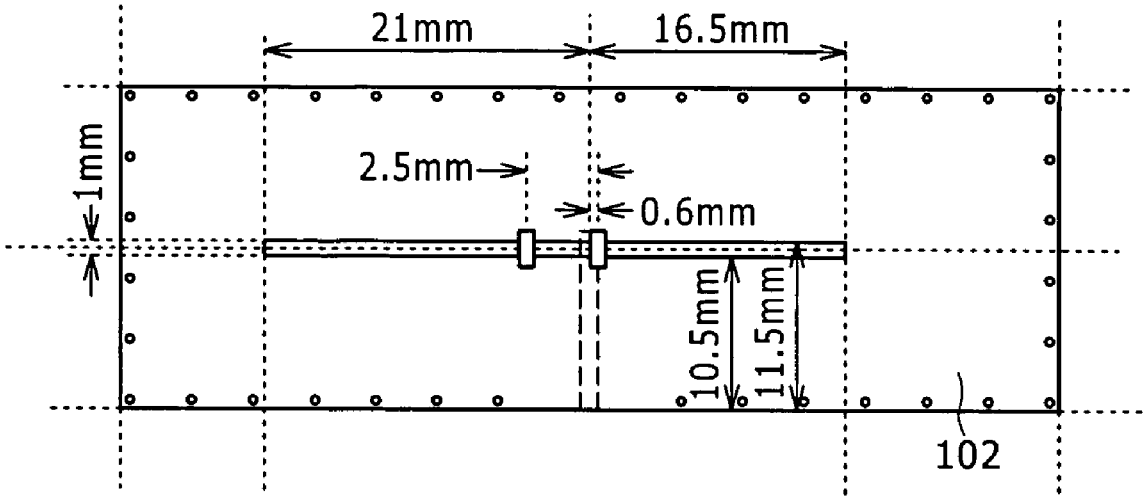
FIG. 4 is a diagram showing an example of configuration of the ground layer 102.

The ground layer 102 is a copper foil pattern formed on substantially the entire surface on the opposite side from the conductor pattern 106 of the dielectric substrate 100. FIG. 4 shows an example of configuration of the ground layer 102. The ground layer 102 has a slot 105 formed by boring the copper foil pattern in the form of a fine line at substantially the center of the ground layer 102. In the example shown in the figures, the slot 105 is substantially orthogonal to an extending direction of the microstrip line 104 formed on the opposite side from the slot 105. When the microstrip line 104 is supplied with power through the feeding point 103, an electromagnetic field is radiated from the slot 105, an electric field is formed so as to traverse the slot 105, and then the electric field forms a standing wave and resonates.

The slot 105 bored in the ground layer 102 is disposed so as to be astride the center line of the substrate which center line goes through the feeding point 103. It is desirable that the specific disposition of the slot 105, that is, the left and right lengths of the slot 105 from the feeding point 103 and the width of the slot 105 be optimized to obtain stable antenna characteristics. In the example shown in the figures, the slot 105 has a width of 1 mm and a length of 37.5 mm, and is formed so as to extend from the center of the ground layer 102 to positions at distances of 21 mm and 16.5 mm.

As shown in FIG. 1 and FIG. 4, a plurality of electric resistors 107 (two electric resistors 107 in the example shown in the figures) are loaded over the slot 105 bored in the ground layer 102. Each of the electric resistors 107 for example has a resistance value of 100 Ω or higher, and is disposed such that both ends thereof are in contact with the ground layer 102. The thus loaded electric resistors 107 have effects of suppressing reflection on the ground layer 102 and bringing out characteristics in a wide band. This will be described later in detail.

In addition, loading the plurality of electric resistors 107 over the slot 105 provides a degree of freedom to adjust impedance matching. For example, loading the plurality of electric resistors 107 at appropriate positions near the center of the slot 105 improves antenna characteristics.

When the slot antenna shown in FIG. 1 and FIG. 2 is applied as a device-incorporated type antenna, it is necessary to eliminate effects of an electromagnetic wave from a peripheral circuit within the device and effects of a reflector around the device, and to consider effects of a high-frequency component of a radiated wide band on a peripheral high-frequency circuit. In the present embodiment, as shown in FIG. 2, when the slot antenna is incorporated into a consumer device or the like, the metallic shield case 201 covering the conductor pattern 106 side is attached to the slot antenna.

Figure 5:
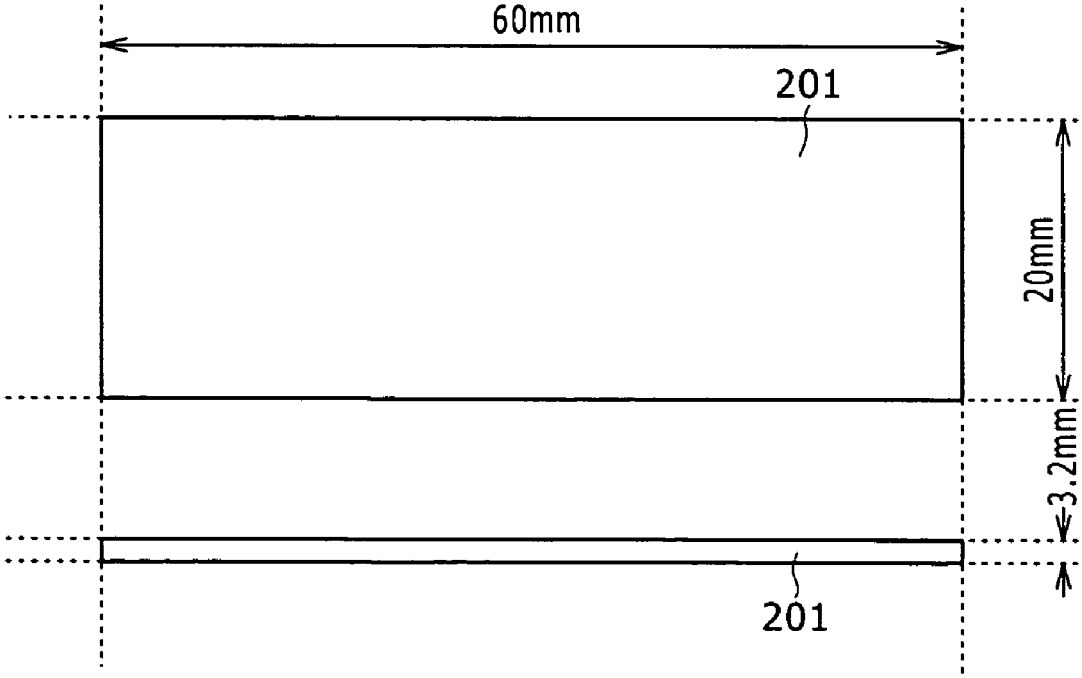
FIG. 5 is a diagram showing a top surface and a side surface of a metallic shield case 201.
Figure 6:
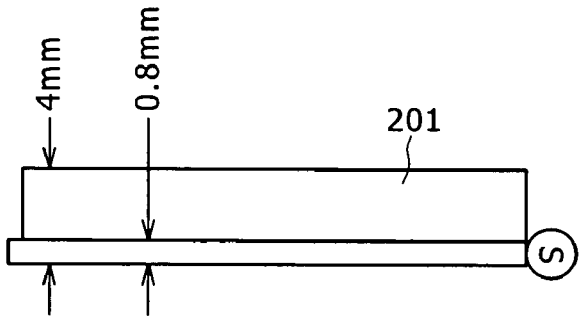
FIG. 6 is a longitudinal section side view of the metallic shield case 201 attached to the antenna substrate of the slot antenna.

FIG. 5 shows a top surface and a side surface of the metallic shield case 201. The metallic shield case 201 is a metallic case having a height of 3.2 mm, a length of 60 mm, and a width of 20 mm and shaped along the conductor pattern 106 formed on the periphery of the surface 101 of the dielectric substrate. FIG. 6 is a longitudinal section side view of the metallic shield case 201 attached to the antenna substrate of the slot antenna. The thickness of the substrate is 0.8 mm, and the height of the metallic case is 3.2 mm, a total height being 4 mm.

When the antenna is incorporated into a small portable device such as a digital camera, a music player or the like, a situation is expected in which communication is performed while a user holds the device by hand. In addition, when the small device has a radio communication function, a circuit other than the antenna is also incorporated into the device. Even when communication is performed while conditions around the antenna are changing and there is a metallic reflector around the antenna, desired antenna characteristics can be stably obtained by attaching the metallic shield case 201.

The slot antenna itself is a narrow-band antenna inherently having an operating band of a few percent, as with a patch antenna. On the other hand, the slot antenna according to the embodiment of the present invention is an antenna for UWB and of a device-incorporated type which antenna can operate in a very wide frequency band of 3.1 to 4.9 GHz. This results from stable characteristics being obtained by optimizing the disposition of the slot 105 made in the ground layer 102 (the left and right lengths of the slot 105 from the feeding point 103 and the width of the slot 105) and eliminating effects of an electromagnetic wave from a peripheral circuit within the device and effects of a reflector around the device by attaching the metallic shield case 201 covering the conductor pattern 106 side when the slot antenna is incorporated into the device.

In addition, the slot antenna according to the embodiment of the present invention suppresses reflection on the ground layer 102 and brings out characteristics in a wide band by an electric resistor 107 loaded over the slot 105 provided in the ground layer 102 such that both ends of the electric resistor 107 are in contact with the ground layer 102. Further, antenna characteristics are improved by loading a plurality of electric resistors 107 at appropriate positions around the center of one slot 105.

When the slot antenna according to the present embodiment is applied as an antenna for UWB, characteristics are ensured by using antennas of the same configuration as a coupler (one pair) for transmission and reception.

Figure 7:
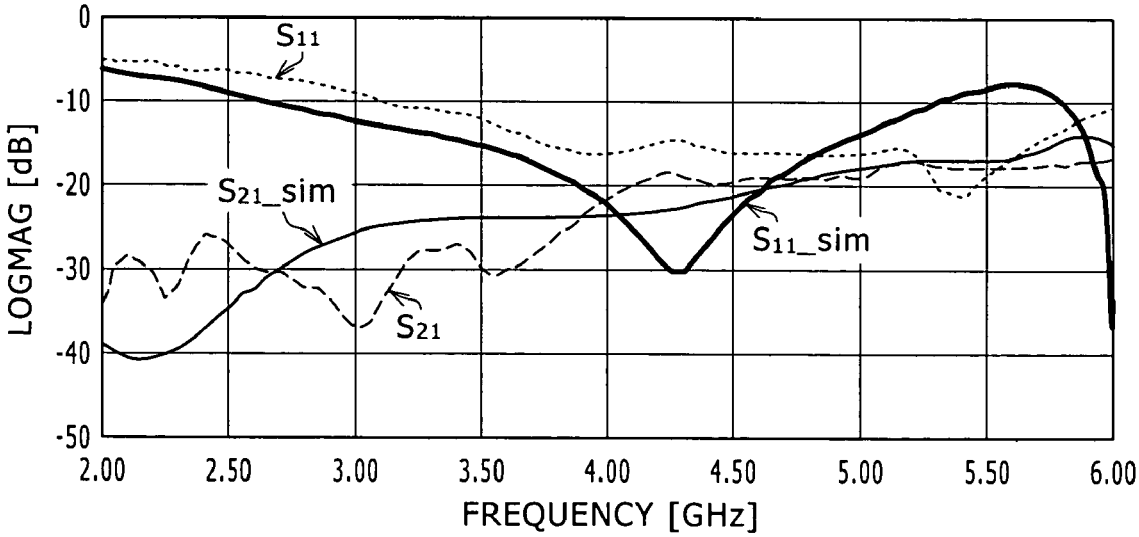
FIG. 7 is a diagram showing characteristics in a case where the slot antenna according to the present embodiment is applied as an antenna for UWB when a distance between the antennas is set at 10 mm.

FIG. 7 shows characteristics when the slot antenna according to the present embodiment is applied as an antenna for UWB. Setting a distance between antennas to 10 mm, simulation and actual measurements were performed. In FIG. 7, an axis of abscissas indicates frequency (GHz), and an axis of ordinates indicates the decibel values of S-parameters.

The S-parameters are defined by the following equation, where $a_1$ and $a_2$ denote an input voltage, and $b_1$ and $b_2$ denote a reflection voltage.

$$\begin{pmatrix} b_1 \\ b_2 \end{pmatrix} = \begin{pmatrix} S_{11} & S_{12} \\ S_{21} & S_{22} \end{pmatrix} \begin{pmatrix} a_1 \\ a_2 \end{pmatrix} \quad \text{[Equation 1]}$$

In the above equation, the S-parameter $S_{11}$ represents a reflection coefficient, and the S-parameter $S_{21}$ represents a coupling coefficient. Better antenna matching is achieved as the reflection coefficient $S_{11}$ becomes lower. The coupling coefficient $S_{21}$ corresponds to the coupling characteristic of the antennas, that is, amplitude characteristics (attenuation factor) of a signal transmitted from a transmitter to a receiver. The coupling coefficient $S_{21}$ that is high and flat in a desired frequency band is good with a little multipath effect.

In FIG. 7, $S_{11}$_sim. and $S_{21}$_sim. denote numerical results obtained by simulation of the reflection coefficient $S_{11}$ and the coupling coefficient $S_{21}$, and $S_{11}$ and $S_{21}$ denote actually measured values. It is understood from FIG. 7 that the antenna for UWB according to the present embodiment can achieve generally required reflection characteristics, the reflection coefficient $S_{11}$ in a UWB low band (3.1 to 4.9 GHz) being −10 dB or lower.

Generally, when antennas are used at a short distance, it is difficult to obtain desired characteristics because there is reflection from the device including the antennas performing communication and reflection from the ground board of the antennas (described above). On the other hand, the antenna for UWB according to the present embodiment can sufficiently achieve desired characteristics even at a short distance of 10 mm.

As shown in FIG. 2 and FIG. 6, the metallic shield case is attached to the antenna substrate to eliminate effects of surrounding electromagnetic waves. In this case, the metallic shield case also causes reflection. In the present embodiment, consideration is also given to effects of the reflection, and the slot antenna according to the present embodiment has sufficient characteristics as an antenna operating in a wide band. Therefore the slot antenna according to the present embodiment can be used within a consumer device.

Since sufficient characteristics can be obtained even at a short distance of 10 mm, data can be transmitted and received at a short distance between the antenna for UWB according to the present embodiment and a device including a UWB radio communication unit.

Figure 8:
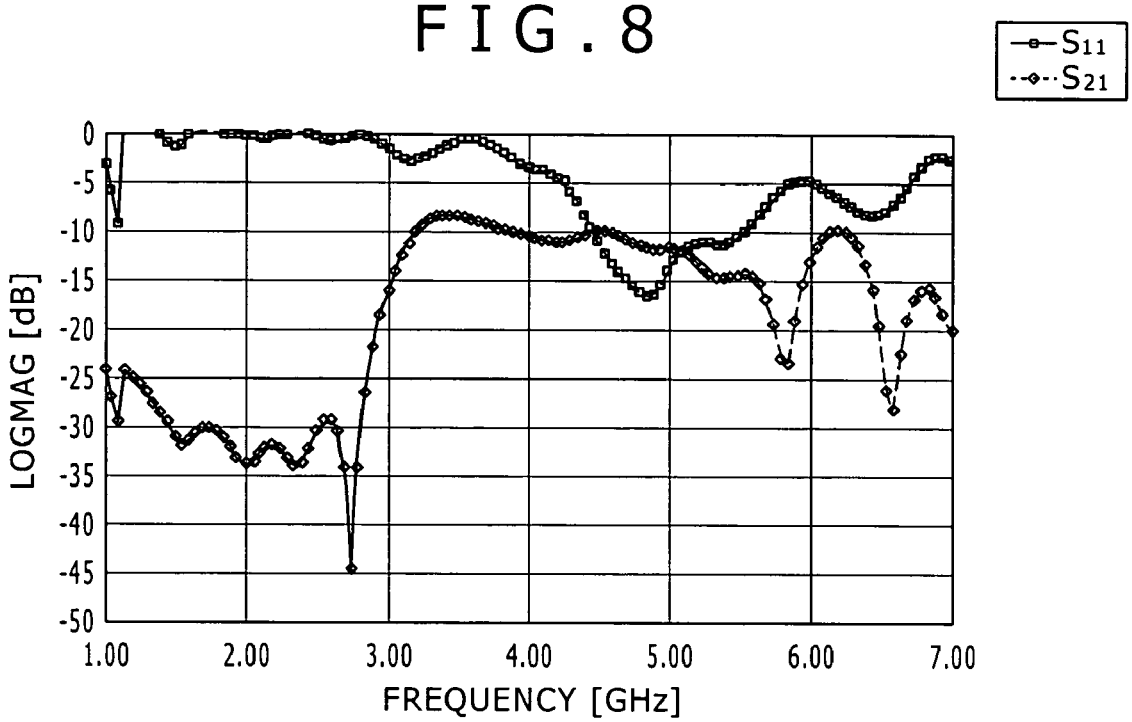
FIG. 8 is a diagram showing S-parameter characteristics of a slot antenna without electric resistors.

The slot antenna according to the embodiment of the present invention suppresses reflection on the ground layer 102 and improves characteristics in a wide band by a plurality of electric resistors 107 loaded over the slot 105 such that both ends of the electric resistors 107 are in contact with the ground layer 102. Further, antenna characteristics are improved by impedance matching. For comparison with FIG. 7, FIG. 8 shows S-parameter characteristics when a slot antenna without the electric resistors 107 is used as an antenna for UWB. In this case, it will be understood that the reflection coefficient is not lower than −10 dB in a range of 3.1 to 4.9 GHz, and that desired characteristics cannot be obtained.

Figure 9:
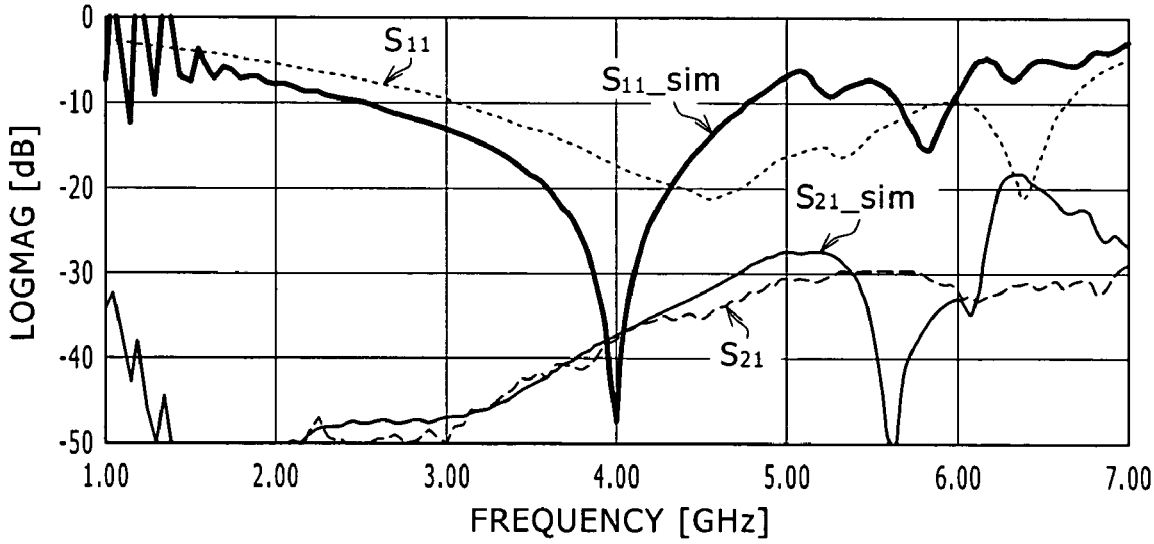
FIG. 9 is a diagram showing characteristics in a case where the slot antenna according to the present embodiment is applied as an antenna for UWB when a distance between the antennas is set at 100 mm.

FIG. 9 shows characteristics (results of simulation and actual measurements) in the case where the slot antenna according to the present embodiment is applied as an antenna for UWB when a distance between the antennas is set at 100 mm. In FIG. 9, an axis of abscissas indicates frequency (GHz), and an axis of ordinates indicates the decibel values of S-parameters. It is understood from FIG. 9 that even when the distance is increased to 100 mm, the antenna for UWB according to the present embodiment can achieve generally required reflection characteristics, the reflection coefficient $S_{11}$ in a UWB low band (3.1 to 4.9 GHz) being −10 dB or lower.

In addition, the present embodiment suppresses reflection on the ground layer 102 and brings out characteristics in a wide band by the electric resistor 107 loaded over the slot 105 provided in the ground layer 102 such that both ends of the electric resistor 107 are in contact with the ground layer 102.

Figure 10:
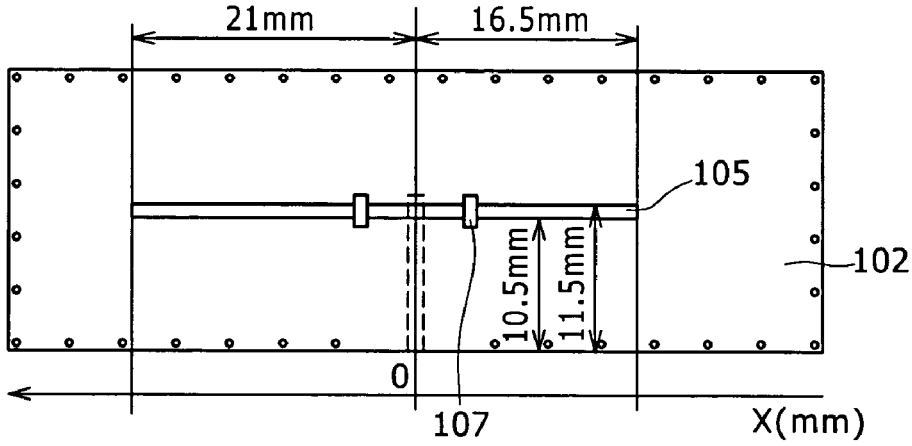
FIG. 10 is a diagram showing the ground layer 102 with electric resistors 107 loaded over a slot 105.

FIG. 10 shows the ground layer 102 with the electric resistors 107 loaded over the slot 105. In FIG. 10, the center of the ground layer is set as a point of x=0 mm, and a left direction is defined as a positive direction and a right direction is defined as a negative direction.

Figure 11:
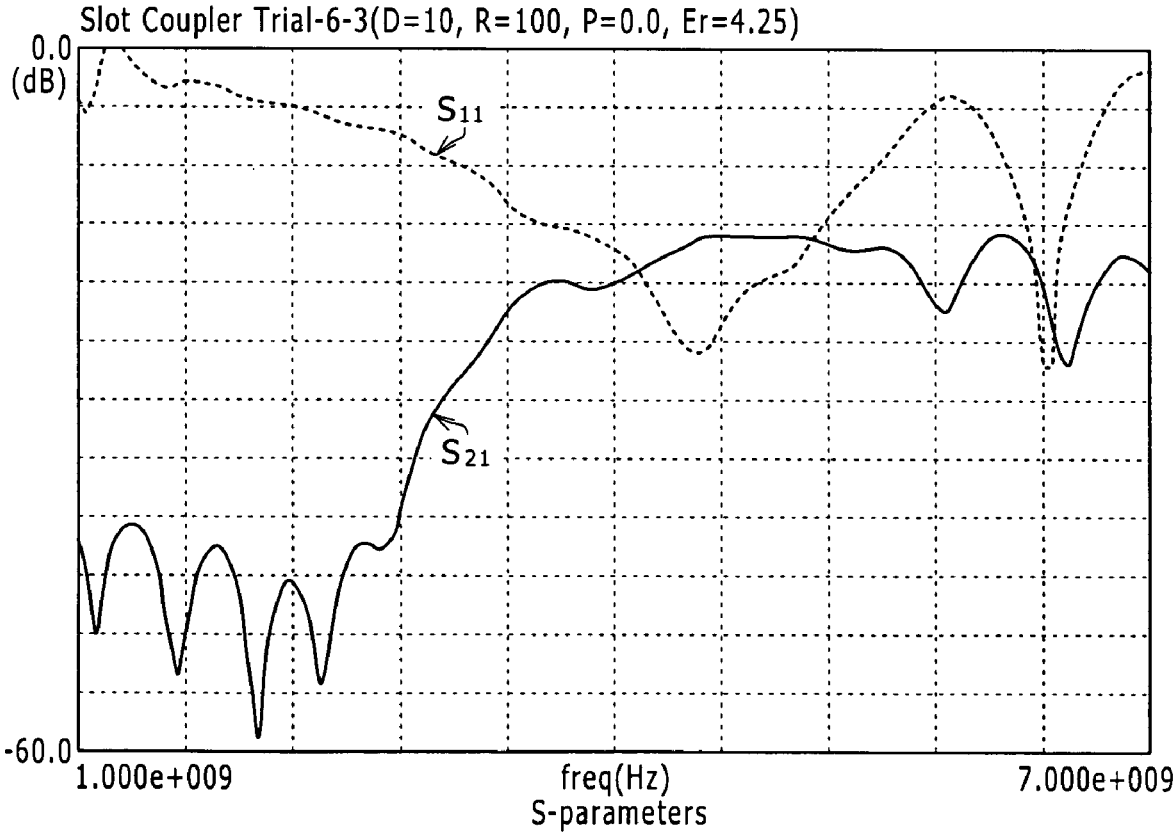
FIG. 11 is a diagram showing S-parameter simulation results when a 100-Ω electric resistor 107 is loaded at a position of x=0 mm on the slot 105.

FIG. 11 shows S-parameter simulation results when a 100-Ω electric resistor 107 is loaded at the position of x=0 mm on the slot 105. In this case, one resistance is loaded over the slot 105. Impedance matching is achieved by loading the electric resistor near the feeding part. Characteristics close to desired characteristics with the reflection coefficient $S_{11}$ lower than −10 dB in a frequency band of 3.1 to 4.9 GHz are obtained.

Figure 12:
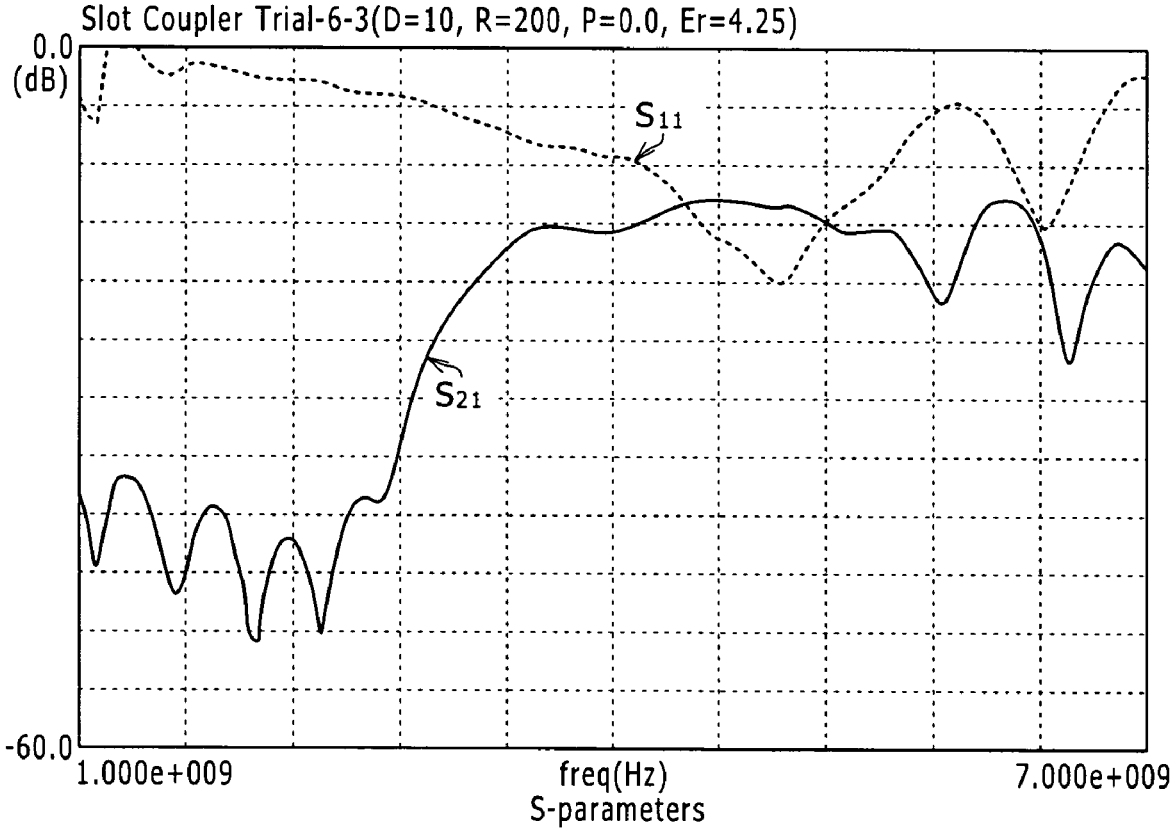
FIG. 12 is a diagram showing S-parameter simulation results when a 200-Ω electric resistor 107 is loaded at a position of x=0 mm on the slot 105.

FIG. 12 shows S-parameter simulation results when a 200-Ω electric resistor 107 is loaded at the position of x=0 mm on the slot 105. As shown in FIG. 12, the reflection coefficient $S_{11}$ is not lower than −10 dB in the frequency band of 3.1 to 4.9 GHz. It is understood from this result that even when the electric resistor 107 is loaded near the feeding part, desired characteristics cannot be obtained unless the electric resistor has an appropriate resistance value.

Further, loading a plurality of such electric resistors 107 over one slot 105 provides a degree of freedom to adjust impedance matching. For example, loading the plurality of electric resistors 107 at appropriate positions near the center of the slot 105 improves antenna characteristics.

Figure 13:
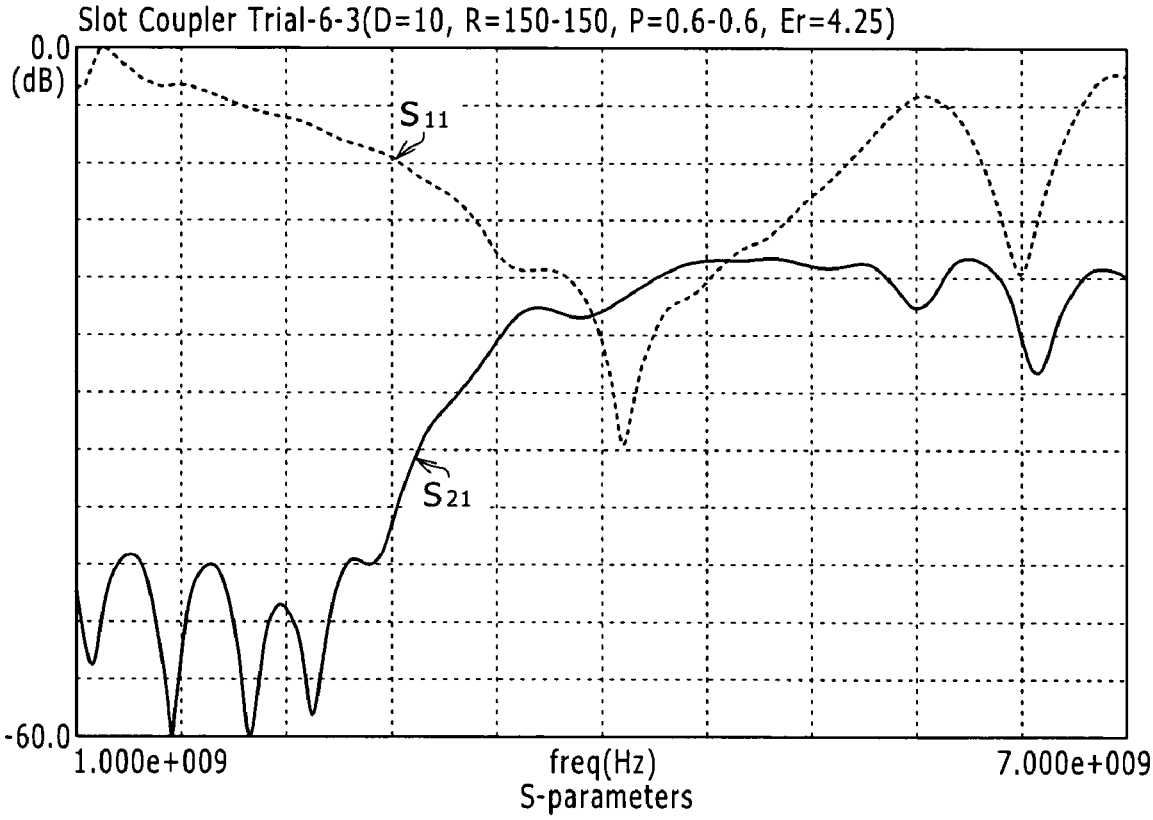
FIG. 13 is a diagram showing S-parameter simulation results when 150-Ω electric resistors 107 are loaded at respective positions of x=±0.6 mm on the slot 105.

FIG. 13 shows S-parameter simulation results when 150-Ω electric resistors 107 are loaded at respective positions of x=±0.6 mm on the slot 105. This result confirms that the two electric resistors 107 having an appropriate resistance value loaded over one slot 105 make the value of the reflection coefficient $S_{11}$ lower than −10 dB in a wider band than one electric resistor 107 having an appropriate resistance value. This is because appropriately loading the two electric resistors contributes more to impedance matching than appropriately loading one electric resistor. Therefore excellent antenna characteristics are obtained over a wide band.

Figure 14:
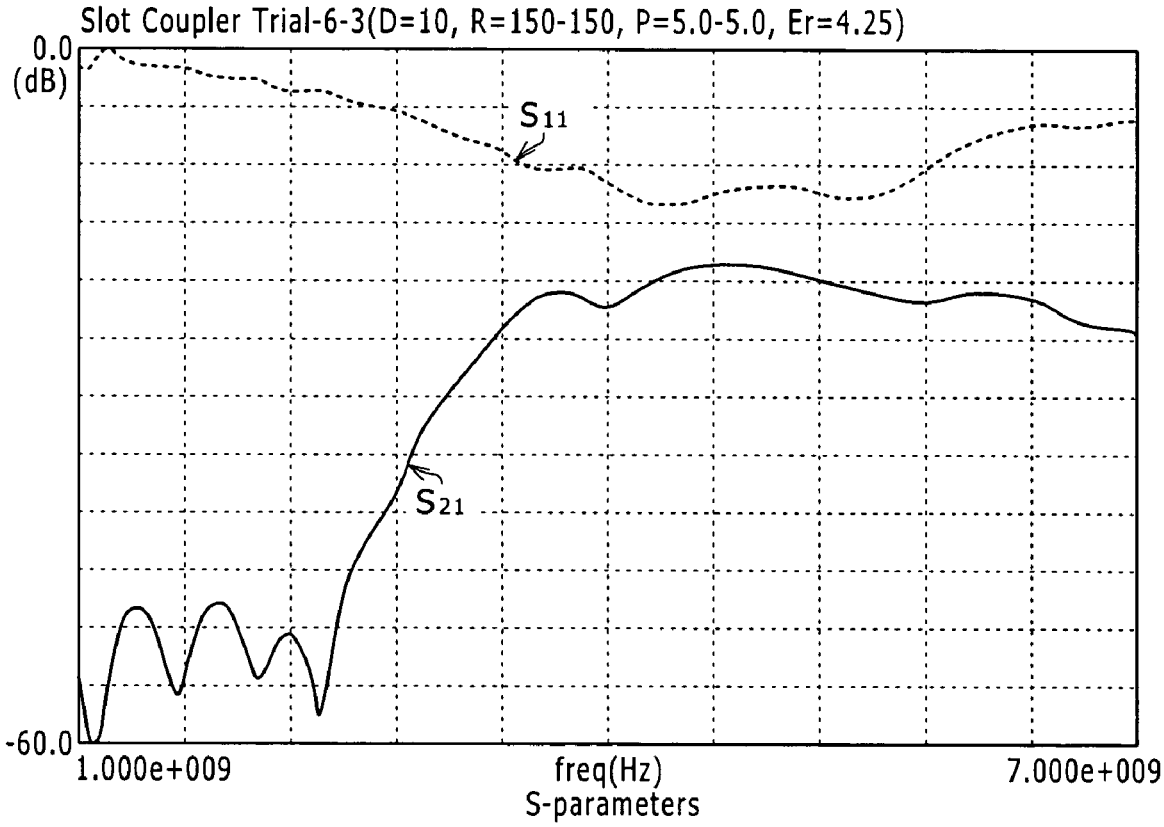
FIG. 14 is a diagram showing S-parameter simulation results when 150-Ω electric resistors 107 are loaded at respective positions of x=±5 mm on the slot 105.

FIG. 14 shows S-parameter simulation results when 150-Ω electric resistors 107 are loaded at respective positions of x=±5 mm on the slot 105. It is understood that when the electric resistors 107 are thus widely separated from the feeding part 103, a frequency range where impedance matching is achieved is narrowed, and therefore good characteristics are not obtained in the desired frequency band of 3.1 to 4.9 GHz. It will be understood by comparing the simulation results shown in FIG. 13 and FIG. 14 that when a plurality of electric resistors 107 are loaded over the slot 105, the plurality of electric resistors 107 are preferably loaded near the feeding part 103.

Figure 15:
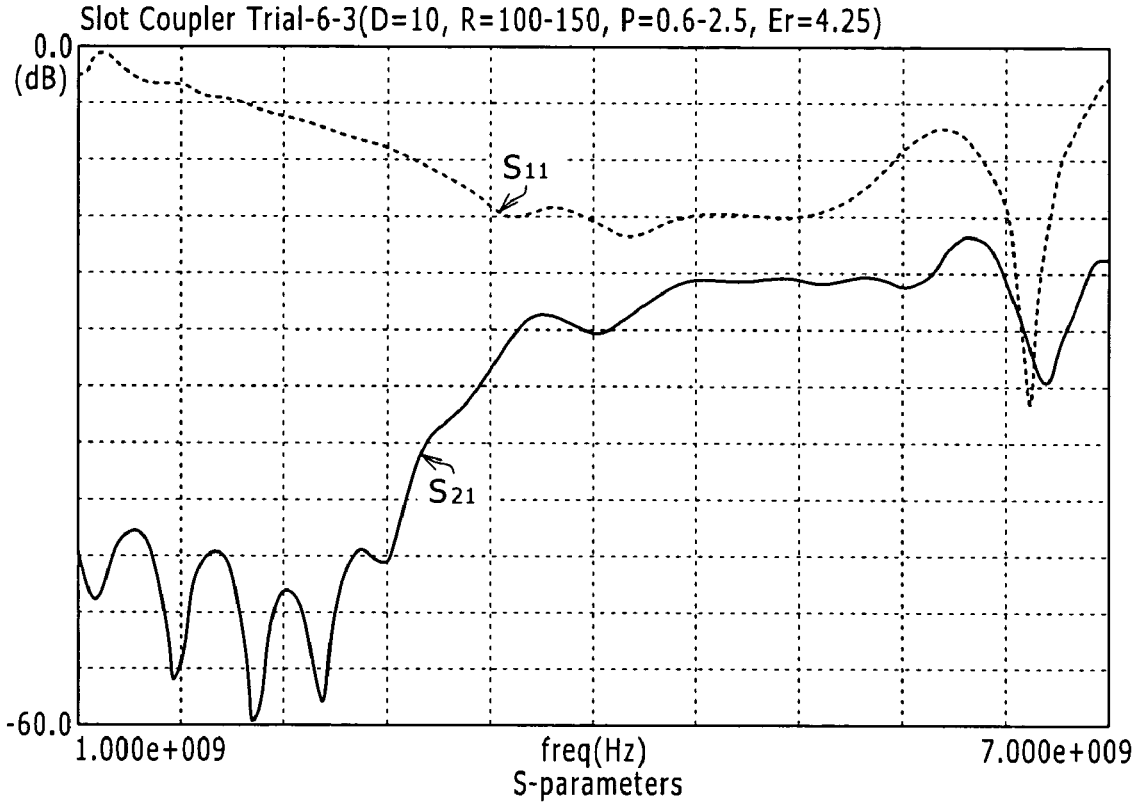
FIG. 15 is a diagram showing S-parameter simulation results when a 100-Ω electric resistor 107 is loaded at a position of x=−0.6 mm on the slot 105, and a 150-Ω electric resistor 107 is loaded at a position of x=+2.5 mm on the slot 105.

FIG. 15 shows S-parameter simulation results in another example of two electric resistors being loaded on the slot 105. In this case, a 100-Ω electric resistor 107 is loaded at a position of x=−0.6 mm on the slot 105, and a 150-Ω electric resistor 107 is loaded at a position of x=+2.5 mm on the slot 105. Thus appropriately loading the plurality of electric resistors 107 having different resistance values at asymmetric positions with respect to the center of the slot 105 (or the position of the feeding point 103) is considered to contribute to ensuring of impedance matching with a higher degree of freedom than loading two electric resistors 107 at symmetric positions. It will be understood from these results that when an electric resistor 107 is to be loaded over the slot 105 of the slot antenna, a method of loading the electric resistor 107 is limited because characteristics vary greatly according to the loading position and the resistance value of the electric resistor 107, and that loading a plurality of electric resistor 107 at appropriate positions is effective in obtaining excellent antenna characteristics over a wide band.

In addition, when the slot antenna according to the present embodiment is applied as an antenna for UWB, characteristics are ensured by using antennas of the same configuration as a coupler (one pair) for transmission and reception.

Figure 16:
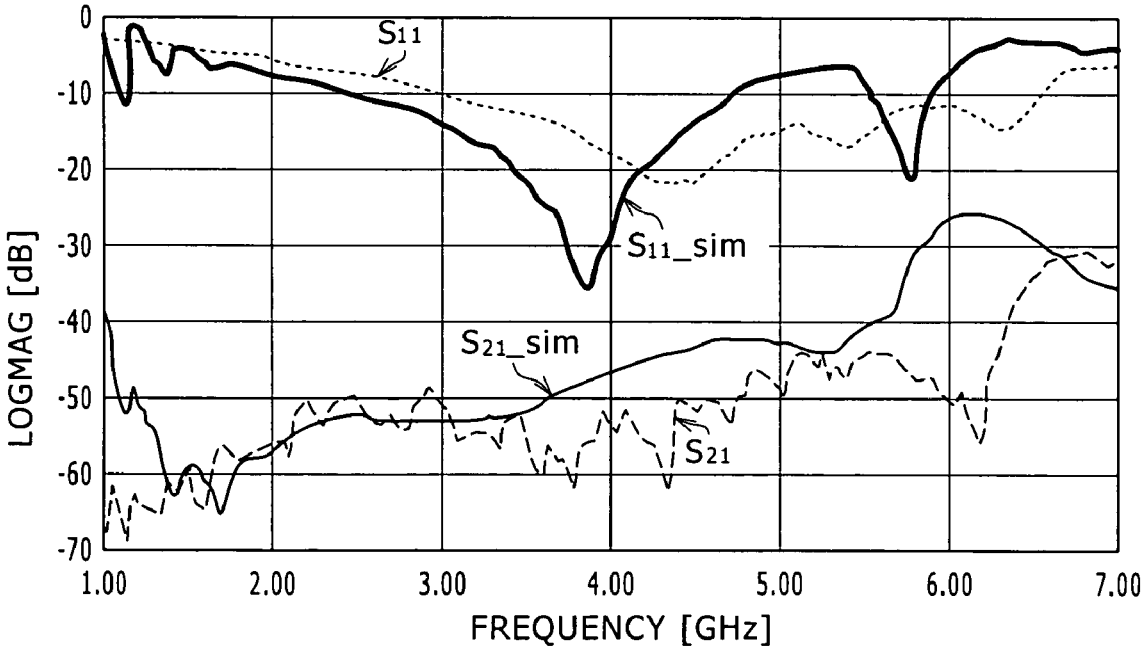
FIG. 16 is a diagram showing S-parameter characteristics when in a case where a distance between a transmitting and a receiving antenna for UWB is set at 50 mm, and a z-direction is set as a direction in which the slots 105 of the respective antennas face each other, one of the transmitting and receiving antennas is moved by 50 mm in an x-direction and by 50 mm in a y-direction.

FIG. 16 shows S-parameter characteristics when in a case where a distance between a transmitting and a receiving antenna for UWB is set at 50 mm, and a z-direction is set as a direction in which the slots 105 of the respective antennas face each other, one of the transmitting and receiving antennas is moved by 50 mm in an x-direction and by 50 mm in a y-direction.

FIG. 16 indicates that even when one of the transmitting and receiving antennas is moved, reflection characteristics are −10 dB or lower in the frequency band (3.1 to 4.9 GHz) of the defined specification, and a high-capacity communication at 100 Mbps or more can be ensured. In addition, though not described here, it has been confirmed that coupling characteristics are at levels allowing transmission in a 500-Mbps mode. It has also been confirmed that similar antenna characteristics are obtained even when the facing directions of the antennas or an angle between the antennas is changed.

In the case where antennas of the same configuration are used as a coupler (one pair) for transmission and reception, there is a fear of effects when the slot 105 parts of the slot antennas are not opposed to each other.

Figure 17:
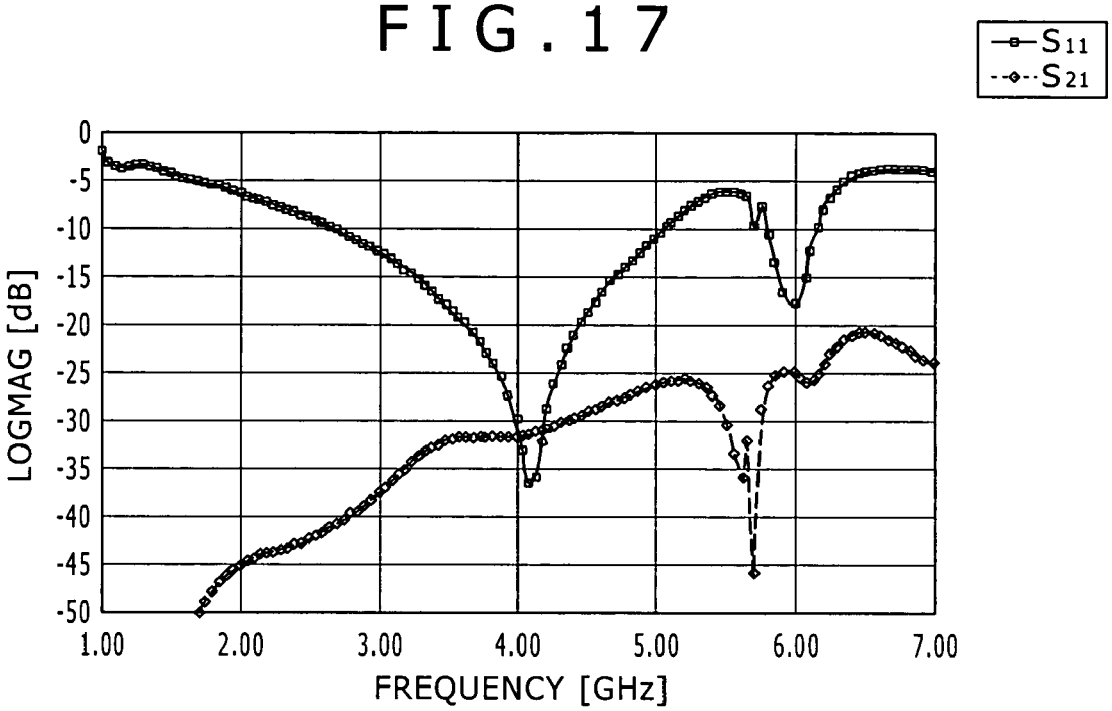
FIG. 17 is a diagram showing S-parameter characteristics when the slot parts of slot antennas for transmission and reception are opposed to each other.
Figure 18:
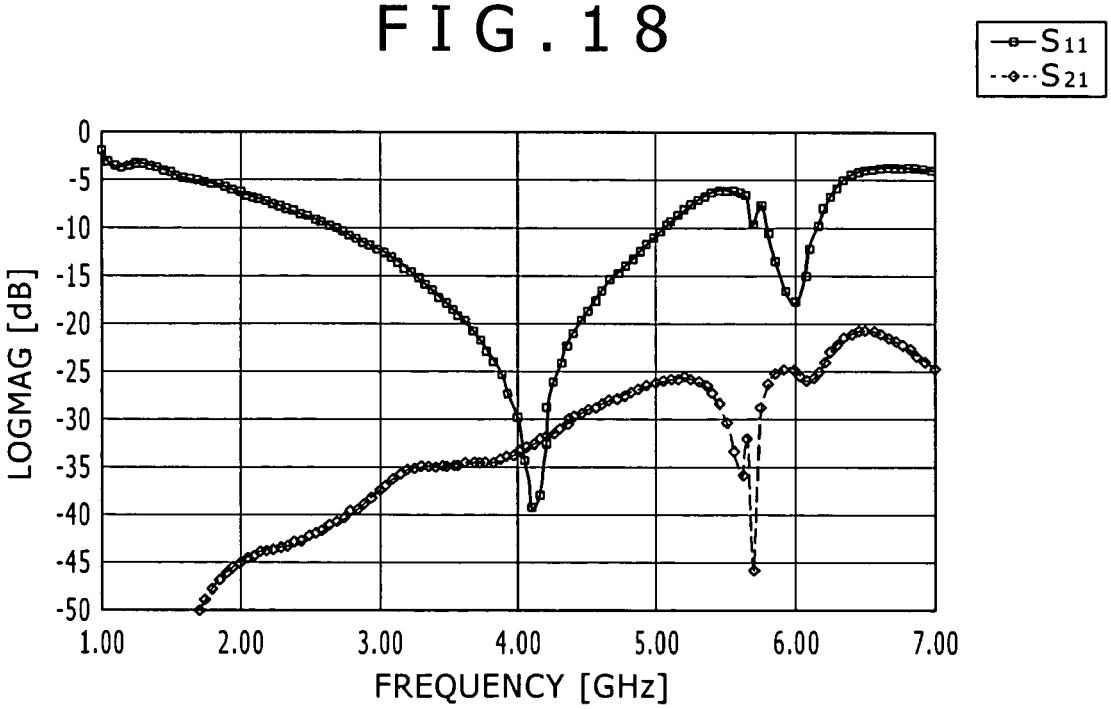
FIG. 18 is a diagram showing S-parameter characteristics when the slot part of the slot antenna on a receiving side is moved by −10 mm in the y-direction with respect to the slot on a transmitting side.

FIG. 17 shows S-parameter characteristics when the slot 105 parts of the slot antennas for transmission and reception are opposed to each other. FIG. 18 shows S-parameter characteristics when the slot 105 part of the slot antenna on the receiving side is moved by −10 mm in the y-direction with respect to the slot on the transmitting side.

It will be understood from a comparison between FIG. 17 and FIG. 18 that even when the slot antennas for transmission and reception are changed from an arrangement in which the slots 105 of the slot antennas are perfectly opposed to each other to an arrangement in which the slots 105 of the slot antennas are shifted from each other by 10 mm, the coupling coefficient ($S_{21}$) is degraded by about −3 dB at 4 GHz, and desired coupling characteristics are obtained.

As described above, in the slot antenna according to the present embodiment, an electric field generated so as to traverse the slot at a time of feeding forms a standing wave and resonates, and the standing wave of the electric field shaped by an electric resistor loaded so as to straddle the slot is generated. Impedance matching can thus be achieved in a wide band. As a result, reflection characteristics are −10 dB or lower in a UWB low band (3.1 to 4.9 GHz). The slot antenna according to the present embodiment can therefore be used as an antenna for UWB.

The slot antenna according to the present embodiment has excellent characteristics in a UWB specification band, is not affected by an electromagnetic wave from a peripheral circuit within a device including the antenna or a reflector around the device, and does not affect a high-frequency circuit within the same device. Further, even when the slot antenna according to the present embodiment is applied to a radio data communication in an ultrashort-distance area such as in a DAN, the slot antenna can provide both excellent reflection characteristics and excellent coupling characteristics as an antenna for UWB even at an ultrashort distance, and effects of reflection from a device including the antenna and reflection from the ground board of the antenna can be avoided.

The present invention has been explained above in detail with reference to specific embodiments thereof. It is obvious, however, that modifications and substitutions in the embodiments may be made by those skilled in the art without departing from the spirit of the present invention. That is, the present invention has been disclosed in a form that is illustrative and contents described in the present specification are not to be construed in a restrictive manner. In order to determine the spirit of the present invention, claims are to be considered.

What is claimed is:

1. A slot antenna comprising:

a dielectric substrate;

a conductor pattern formed on a first surface of the dielectric substrate;

a ground layer formed on a second surface of the dielectric substrate;

a feeding point disposed at substantially the center of one edge of the conductor pattern;

a microstrip line extending from the feeding point to substantially a center of the conductor pattern;

a slot in the ground layer having a predetermined width at a position at which the slot straddles a center line of the dielectric substrate, the center line passing through the feeding point; and an electric resistor loaded over the slot such that both ends of the electric resistor are in contact with the ground layer.

2. The slot antenna as claimed in claim 1, further comprising a metallic shield case mounted along the conductor pattern.

3. A slot antenna comprising:

a dielectric substrate;

a conductor pattern formed on a first surface of the dielectric substrate;

a around layer formed on a second surface of the dielectric substrate;

a feeding point disposed at substantially the center of one edge of the conductor pattern;

a microstrip line extending from the feeding point to substantially a center of the conductor pattern; and a slot in the ground layer having a predetermined width at a position at which the slot straddles a center line of the dielectric substrate, the center line passing through the feeding point, wherein one or a plurality of electric resistors are loaded at appropriate positions near a center of the slot.

4. The slot antenna as claimed in claim 3, further comprising a metallic shield case mounted along the conductor pattern.

5. A slot antenna comprising:

a dielectric substrate;

a conductor pattern formed on a first surface of the dielectric substrate;

a ground layer formed on a second surface of the dielectric substrate;

a feeding point disposed at substantially the center of one edge of the conductor pattern;

a microstrip line extending from the feeding point to substantially a center of the conductor pattern; and a slot in the around layer having a predetermined width at a position at which the slot straddles a center line of the dielectric substrate, the center line passing through the feeding point, wherein a plurality of electric resistors having different resistance values are loaded at asymmetric positions with respect to a center of the slot.

6. The slot antenna as claimed in claim 5, further comprising a metallic shield case mounted along the conductor pattern.

* * * * *